United States Patent [19]

Bergerud

[11] 4,329,746

[45] May 18, 1982

[54] FOLDING BED-FRAME MEMBER AND BED ASSEMBLY

[76] Inventor: Wilson L. Bergerud, 30 Herring St., Harrington Park, N.J. 07640

[21] Appl. No.: 150,635

[22] Filed: May 16, 1980

[51] Int. Cl.[3] ..... A47C 17/40; A47C 17/48

[52] U.S. Cl. ..... 5/164 R; 5/136

[58] Field of Search ..... 5/133–138, 5/140, 144, 145, 149, 164 R, 165, 176 R, 184

[56] References Cited

U.S. PATENT DOCUMENTS

| | | | |
|---|---|---|---|
| 1,814,828 | 7/1931 | Chackes et al. | 5/164 R X |
| 3,116,494 | 1/1964 | Bennett et al. | 5/164 R X |
| 3,179,956 | 4/1965 | Bennett | 5/164 R X |
| 3,863,281 | 2/1975 | Tosic | 5/136 |

*Primary Examiner*—Stephen J. Novosad

[57] ABSTRACT

A spring-balanced, wall-type bed-frame member, which is adapted to support at least a portion of a mattress assembly, is pivotable between a vertical position adjacent a wall and a horizontal position upon a floor for use. The bed frame portion upon which the mattress assembly will lie is pivotally mounted upon a support member mounted on rollers. One end of a connecting bar is pivotally attached to that bed frame portion towards the foot end of the bed frame relative to the pivot and the other end of the connecting bar is fixed relative to the floor and also pivotally mounted. Spring means join the bed frame portion lying towards the headboard portion of the bed frame with the bottom portion of the support section mounted on rollers. Rotation of the bed frame from its vertical position adjacent the wall towards the floor causes the support member mounted on rollers to move towards the wall in response to the rotational movement of the headboard portion of the bed frame as it acts through the spring on the frame mounted on rollers.

7 Claims, 6 Drawing Figures

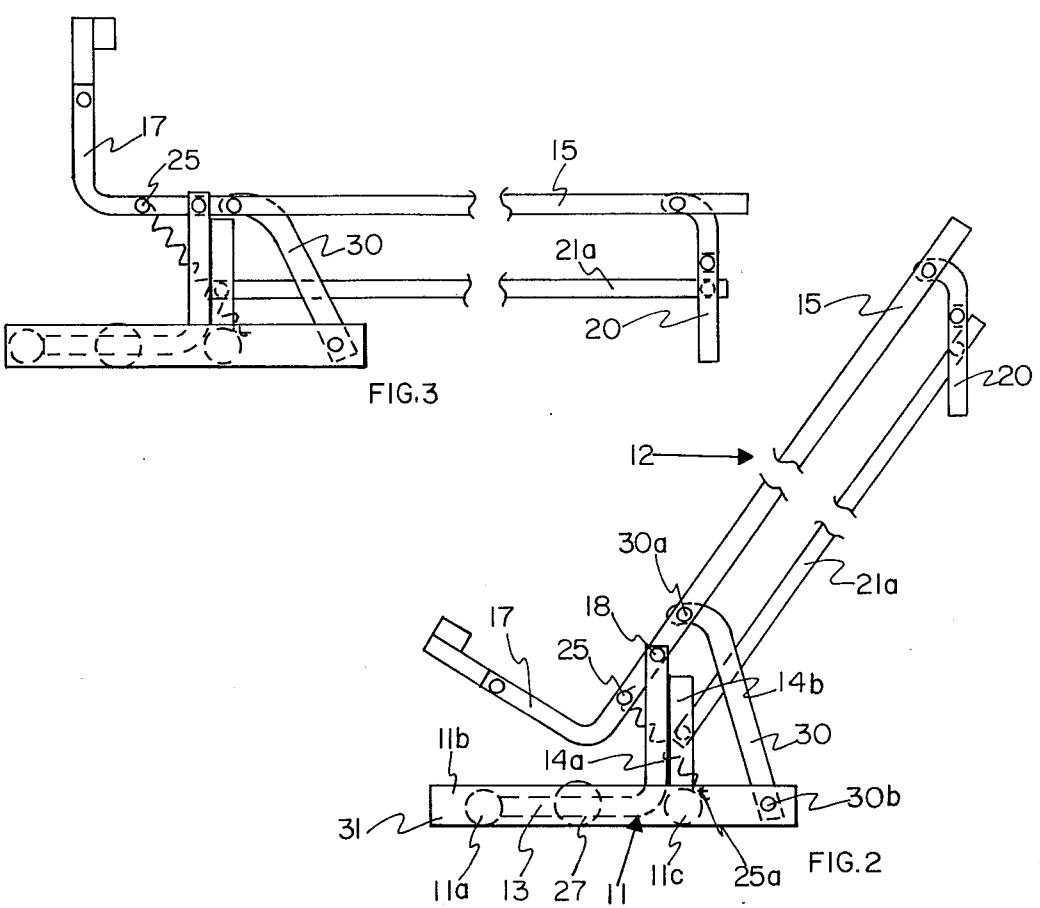
15
20
21a
12
30a
18
25
17
14a
14b
30
30b
25a
11c
11
27
13
11a
11b
31
FIG.2
15
21a
20
30
25
17
FIG.3
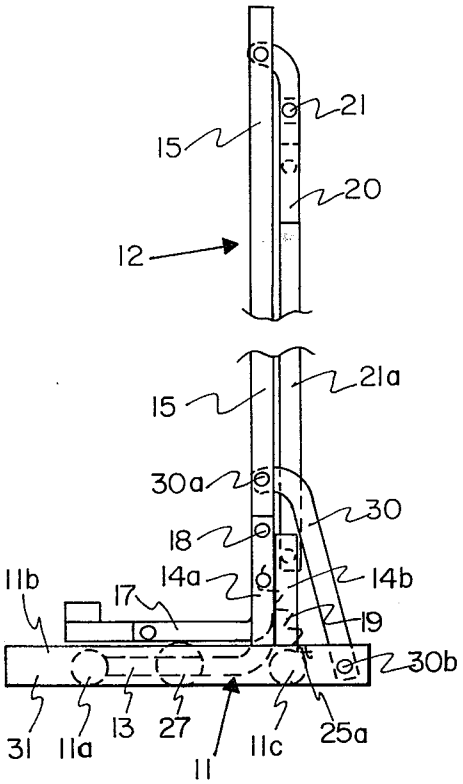
21
20
15
12
21a
30
14b
19
30b
25a
11c
11
15
30a
18
14a
17
27
13
11a
11b
31
FIG. 1

FOLDING BED-FRAME MEMBER AND BED ASSEMBLY

BACKGROUND OF THE INVENTION

1. Field of the Invention

The present invention relates to a wall-type bed-frame member which is adapted to move towards the wall to save normally unused space when it is rotated downwardly so as to rest upon a floor for use.

2. Description of the Prior Art

Wall type bed assemblies, which contain: (1) a mattress assembly (e.g., mattress and either springs or box-spring); and (2) a pivotal bed-frame, are known. Two recent examples are shown in U.S. Pat. No. 4,050,106 to L. Wolfe and in applicant's copending U.S. Application Ser. No. 801, filed Jan. 4, 1979, now U.S. Pat. No. 4,234,979. In such devices, however, the bed frame portion which is adapted to hold the mattress assembly is pivotally mounted upon a support section fixedly mounted to the floor. Rotation of the mattress support section from its vertical position adjacent the wall to its horizontal position on the floor for use leaves a larger degree of unused space between the headboard section of the bed frame and the wall than existed between that portion of the frame and the wall when the bed was in the vertical stored position. It would be desirable to have the headboard section of the bed frame as close to the wall as possible when it is in the horizontal position and still allow for sufficient wall clearance for that portion of the bed frame upon its rotation into its vertical stored position.

SUMMARY OF THE PRESENT INVENTION

The present invention relates to a wall-type bed-frame member, which is adapted to support at least a portion of a mattress assembly, and which is pivotable between a vertical position adjacent a wall and a horizontal position upon a floor for use. The bed frame member adapted to support the mattress assembly is pivotally mounted on a support section carried by rollers. A bar connecting a portion of the headboard section of the pivotally mounted bed frame and the movable support section allows for movement of the support section towards the wall as the headboard section of the bed frame is rotated in an upward direction and towards the wall as the bed frame portion that is adapted to support the mattress assembly is rotated into its horizontal position to rest upon the floor.

DESCRIPTION OF THE DRAWINGS

The present invention may be further understood by reference to the Drawings which form a portion of this specification wherein:

FIG. 1 is a side view of the bed frame of the present invention in its vertical stored position adjacent a wall;

FIG. 2 is a view similar to the view shown in FIG. 1 showing the bed frame after it has been rotated downwardly to a position intermediate between its vertical position adjacent the wall and its horizontal position on the floor;

FIG. 3 is a view similar to the views shown in FIGS. 1 and 2 showing the bed frame after it has been rotated to its horizontal position on the floor;

DETAILED DESCRIPTION OF THE PREFERRED EMBODIMENTS OF THE INVENTION

Figure 4:
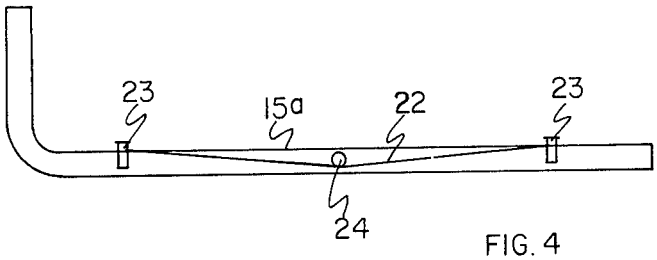
FIG. 4 shows a cross-sectional view of the preferred members for the bed frame portion adapted to support the mattress assembly.
Figure 5:
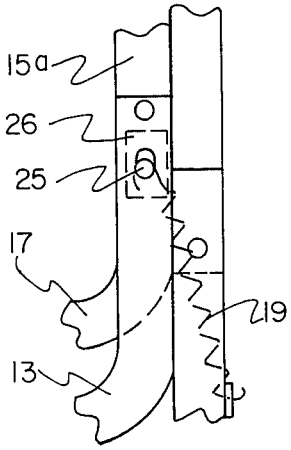
FIG. 5 is an enlarged side view of the frame member of the present invention when it is in its vertical stored configuration.

FIGS. 1–3 show the bed frame member of the present invention from the side when in its vertical, stored position (FIG. 1), an intermediate position (FIG. 2), and in its horizontal, deployed position (FIG. 3).

The frame member of this invention comprises a base 11 on which are rollers 11*a* for movement upon the floor towards and away from the wall, as will be described in greater detail later. If desired, the rollers can be stabilized against movement parallel to their respective axis by riding in a roller track 11*b* which has a generally U-shaped cross-section when viewed in a direction perpendicular to the axis of rollers 11*a*. The base section 11 carries a mattress support section 12 which is pivotally mounted on a portion of support 11 so as to be pivotable between a vertical position adjacent a wall of a room and a horizontal position upon the floor of the room.

The base 11 is generally L-shaped and comprises one base section 13 which is parallel to the floor and on which are mounted front and back rollers 11*a* and 11*c* and another section 14 is vertically oriented. The vertical section can be formed of a single member, or, as shown in the Drawings, two joined members 14*a* and 14*b*.

Pivotally attached to a portion of section 14 (e.g., section 14*a*) of the base 11 is support section 12 which comprises a relatively long mattress support section 15 against which the bottom of a mattress assembly (not shown) is placed. The mattress support section 12 is approximately dimensioned in length so that it provides adequate support for the mattress assembly. It will be generally of the same length as the mattress assembly or slightly longer. Its width can vary. If only one bed frame member is used to support the mattress assembly it can have a width which is approximately coextensive with the mattress assembly with permanent cross supports or cross supports of fixed length. If desired, however, the width of the bed frame can be substantially less than the width of the mattress assembly and a plurality of such bed frames can be used to support the mattress assembly as described in applicant's U.S. Application Ser. No. 801, now U.S. Pat. No. 4,234,979. Such an arrangement allows for potential use of the same frames with differing sized mattresses (e.g., double, queen or king sized) without the need to purchase additional frames having fixed widths.

The generally planar support section 15 preferably merges at one end thereof, adjacent the base 11 with a short, planar support member 17 which is generally perpendicular to the support section 15 and which provides a resting place for the mattress assembly when the L-shaped support section 12 is pivoted to its vertical position. The bottom of the mattress assembly can be secured to the support section 15 by any means known to persons of ordinary skill in the art, e.g., straps, latches, screws, bolts, etc.

The support section 12 is preferably formed of hollow steel tubing so as to provide a construction which is both light and durable. This material gives a support section which is easily pivotable about pivot 18 on base portion 14*a* because of its relatively low weight. As shown in FIG. 4, it is also preferable to have the tubular members 15 of support section 12 reinforced so as to be capable of supporting a greater amount of weight than normal without deformation of the tubing. Such an embodiment allows the use of lighter weight tubing and is preferred from a weight reduction viewpoint. The Figure shows that the tubing forming support side member 15*a* has attached to it on one side thereof, by suitable fastening means 23, the two portions of a metal strap (e.g., a 26 gauge, $\frac{3}{4}$ inch metal strap) which is under tension by virtue of its secure attachment at said portions and its being brought to bear against the opposed side of the tubular member by member 24, which can be the same type of means as fastening means 23. If desired, the metal strap 22 can be replaced with other forms of reinforcing member, for example, metal wires, cables, and the like.

As best shown in FIG. 1, an anti-shock bumper 27 can be attached to a portion of base section 13 to cushion the movement of support section 17 as it nears base section 13. It can comprise a generally cylindrical rubber material surrounding a suitably dimensioned rod which is attached at either of its respective ends to a portion of base section 13.

In order to provide for the secure footing on the floor of that portion of the support section 15 which will form the foot of the bed, a pivotable leg 20 is provided adjacent that end of the support section. As best shown in FIG. 1–3, the leg is pivotally connected at one of its ends to the support section 15 and has a second pivotal connection 21, interior of the end connected to the support section 15, which is linked to a portion of base 11 at a location below pivot 18 on the base 11 by means of a planar linkage member 21*a*. When the support 12 is pivoted downwardly from its vertical, stored position, the linkage member 21*a* causes pivotal rotation of the leg 20 until it reaches a substantially perpendicular position with relation to the plane of support section 15 and thereby provides a support for the foot of the bed in its fully deployed position as depicted in FIG. 3.

The manner in which the bed frame of the present invention shifts towards the wall, relative to its position when in a vertical, stored position, as it is lowered to rest upon a floor is best understood by comparing FIGS. 1–3 with each other. As the frame member 12 is rotated about pivot point 18, mattress support section 12 descends towards the floor, whereas headboard support section 17 is pivoted upwardly. Spring means 19 connect to an attachment point 25 on headboard support section 17 and another attachment point 25*a* on the bottom of support 14*b*. The movement of the headboard section 17 upwards and towards the wall during its rotational movement exerts a stretching action on the spring 19 which tends to urge the roller mounted base 11 towards the wall, as shown by comparing FIG. 2 with FIG. 1. A connecting bar 30 pivotally attached at 30*a* to mattress support section 15 and pivotally, though fixedly, mounted at 30*b* to the floor, for example, through fixedly mounted roller track 31, moves in conjunction with shifting of the moveable frame. This bar 30 shifts its upper portion towards the wall and assumes a less horizontal orientation. Movement of the mattress support section 15 towards the floor, results in unfolding of the support leg 20 adjacent the foot of the bed frame by operation of arm 21*a*.

FIG. 3 shows the bed frame of the present invention in its fully unfolded configuration on a floor with the roller mounted base 11 shifted towards the wall to occupy space that would otherwise be wasted if the bed frame were pivotally mounted upon a base that was fixed to the floor against such shifting movement. Such a shifting of the bed frame of the present invention towards the wall gives a correspondingly greater degree of clearance between the foot of the frame and any furniture or wall immediately adjacent to it. Such considerations are of importance in otherwise cramped living quarters.

Figure 6:
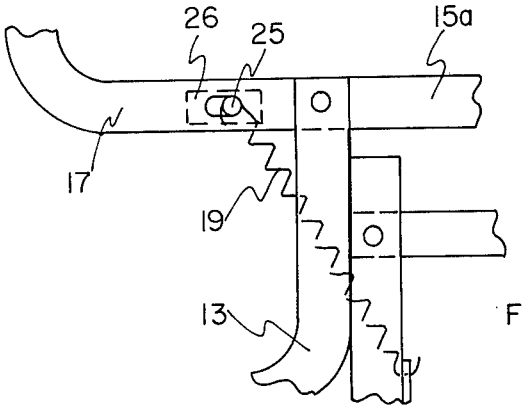
FIG. 6 is a view similar to that shown in FIG. 5 when the frame is in its fully deployed configuration.

In a preferred embodiment of the present invention (as best shown in FIG. Nos. 5 and 6), the upper ends of the spring means 19 are attached to a generally round shaft 25 which is inserted into a hole (e.g., a $\frac{3}{8}$ inch hole) in a rectangular carrier 26 inside the tubular side member 15*a*. The shaft passes through a slightly larger hole (e.g., a $\frac{5}{8}$ inch hole) formed in the surface of the member 15*a*. When the support member 15*a* is rotated downwardly and reaches a certain position (e.g., a 30 degree angle to the horizontal), the compressive tensioning action of the spring means 19 causes the shaft 25 to shift (as shown by the arrow in FIG. 6) against the edge of the larger hole formed in support member 15*a* providing a certain degree of locking action which allows the bed frame to be moved gently to the floor and be locked in that position. Some slight degree of force is needed to lift the support 15*a* back past the position at which this shifting occurs and allow full compression action of the spring means 19 to come into play. This causes the shaft 25 to shift back to its original position and allows for easy raising of the frame member to its stored, vertical configuration with a concomitant shifting of the roller mounted base 11 back to its original position.

The foregoing is merely illustrative of the present invention and should not be construed in a limiting sense. The scope of protection that is sought is set forth in the claims which follow.

What is claimed:

1. A bed frame member for a wall-type bed which is adapted to be pivotable between a vertical position adjacent a wall and a horizontal position upon a floor, said frame member comprising:

(a) a base which is adapted to rest upon the floor and be moveable with respect to the wall; and (b) a support section pivotally mounted on the base, means responsive to the rotation of said support section causing movement of the base and support section towards the wall as the support section is pivotally moved for deployment on the floor.

2. A bed frame as claimed in claim 1 wherein spring means joins a portion of the base and support to cause said movement of said base.

3. A bed frame as claimed in either claim 1 or 2 wherein the base is mounted on rollers.

4. A bed frame as claimed in either claim 1 or 2 wherein the support section also comprises pivotal leg means at one end thereof which is remote from the point of pivotal mounting of the support section to the base.

5. A bed frame as claimed in either claim 1 or 2 wherein at least some of the support section comprises tubular metal members.

6. A frame member as claimed in claim 2 wherein the spring means are attached to a shaft member which is mounted for shiftable movement in the support section.

7. A bed frame member as claimed in either claim 1 or 2 wherein at least some of the support section comprises tubular metal members which are reinforced by a metal member fixed at two of its portions on one side of the tubular member and is brought to bear against the opposed side of the tubular member.

* * * * *